United States Patent [19]

Brazier

[11] 4,218,805

[45] Aug. 26, 1980

[54] APPARATUS FOR CLEANING FLOORS, CARPETS AND THE LIKE

[75] Inventor: Alan J. Brazier, Birmingham, England

[73] Assignee: Vax Appliances Limited, Worcester, England

[21] Appl. No.: 957,408

[22] Filed: Nov. 3, 1978

[51] Int. Cl.[2] ..... A47L 7/00

[52] U.S. Cl. ..... 15/321; 15/328; 15/353; 55/462; 55/DIG. 3

[58] Field of Search ..... 15/320, 321, 353, 328; 55/216, 447, 462, DIG. 3

[56] References Cited

U.S. PATENT DOCUMENTS

| | | | |
|---|---|---|---|
| 2,719,596 | 10/1955 | Kent et al. | 55/216 |
| 2,844,840 | 7/1958 | Gray | 15/328 X |
| 3,055,039 | 9/1962 | Smith | 15/320 X |
| 3,165,774 | 1/1965 | Barba | 15/321 X |
| 3,609,946 | 10/1971 | Nakagawa et al. | 15/327 D X |
| 3,720,977 | 3/1973 | Brvcki | 15/353 X |
| 3,921,250 | 11/1975 | Jerabek | 15/353 |
| 4,010,015 | 3/1977 | Brown | 15/353 X |
| 4,041,569 | 8/1977 | Petersen | 15/353 |

*Primary Examiner*—Christopher K. Moore
*Attorney, Agent, or Firm*—Claude A. S. Hamrick

[57] ABSTRACT

Suction cleaning apparatus comprising a container adapted for the collection of a liquid is provided with an inlet for connection to a suction head adapted for picking up liquid whereby incoming air flow is directed substantially radially inwardly relative to the container and impinges directly on an inner wall whereby it is spread in substantially equal and opposite streams around the interior of the container. The inner wall surrounds a suction inlet whereby suction is applied to the interior of the container and the arrangement minimises the tendency for a vortex to be generated in air flow towards such suction inlet, thereby reducing the tendency of foam to be produced on the surface of the collected liquid within the container.

4 Claims, 3 Drawing Figures

APPARATUS FOR CLEANING FLOORS, CARPETS AND THE LIKE

REFERENCES TO RELATED APPLICATION

This application is related to subject matter disclosed in my copending applications, Ser. Nos. 905,396 and 905,417, both filed on May 12, 1978, and Ser. No. 957,212, filed on Nov. 3, 1978, all of which are assigned to a common assignee.

BACKGROUND OF THE INVENTION

This invention relates to apparatus for cleaning floors, walls, carpets, curtains, upholstery and the like.

Whilst the invention has been developed in connection with a dual purpose suction cleaning apparatus suitable both for dry suction cleaning and water extraction cleaning, the present invention is specifically concerned with an improved arrangement for the collection of liquid as in a water extraction cleaning process.

SUMMARY OF THE INVENTION

According to this invention we provide suction cleaning apparatus comprising a container adapted for the collection of a liquid having an inlet for connection with a suction head adapted for picking up liquid, and a motor driven suction unit with an air inlet communicating with said container to apply suction thereto, wherein the inlet for connection with the suction head is disposed in an outer, lateral wall of the container adjacent to the upper edge thereof and an inner wall is provided within the container in spaced relation to the outer wall so that incoming air flow is directed substantially radially inwardly and directly onto the inner wall and is spread downwardly and in substantially equal and opposite streams along said inner wall, the container having a suction inlet arranged within said inner wall and through which suction from the suction unit is applied to the container.

Preferably the container is of circular shape in plan and the inner wall is of annular form with its lower edge spaced above the bottom of the container.

This arrangement has the advantage that the incoming air is subjected to an abrupt change of direction as it strikes the inner wall so facilitating separation of liquid droplets entrained in the air flow, whereby the air flow itself is distributed substantially uniformly around the inner wall so as to flow under the lower edge of the latter at all points around the periphery whilst moving in a substantially radial direction with a minimum component of circumferential movement. This reduces the tendency for a vortex to be established centrally of the container, and this in turn reduces the production of foam on water collected within the container which, when the apparatus is being used for water extraction cleaning, will normally contain a detergent or wetting agent which tends to promote the creation of such foam.

BRIEF DESCRIPTION OF THE DRAWINGS

These and other features of the invention will now be described by way of example with reference to the accompanying drawings wherein.

DESCRIPTION OF THE PREFERRED EMBODIMENTS

Figure 1:
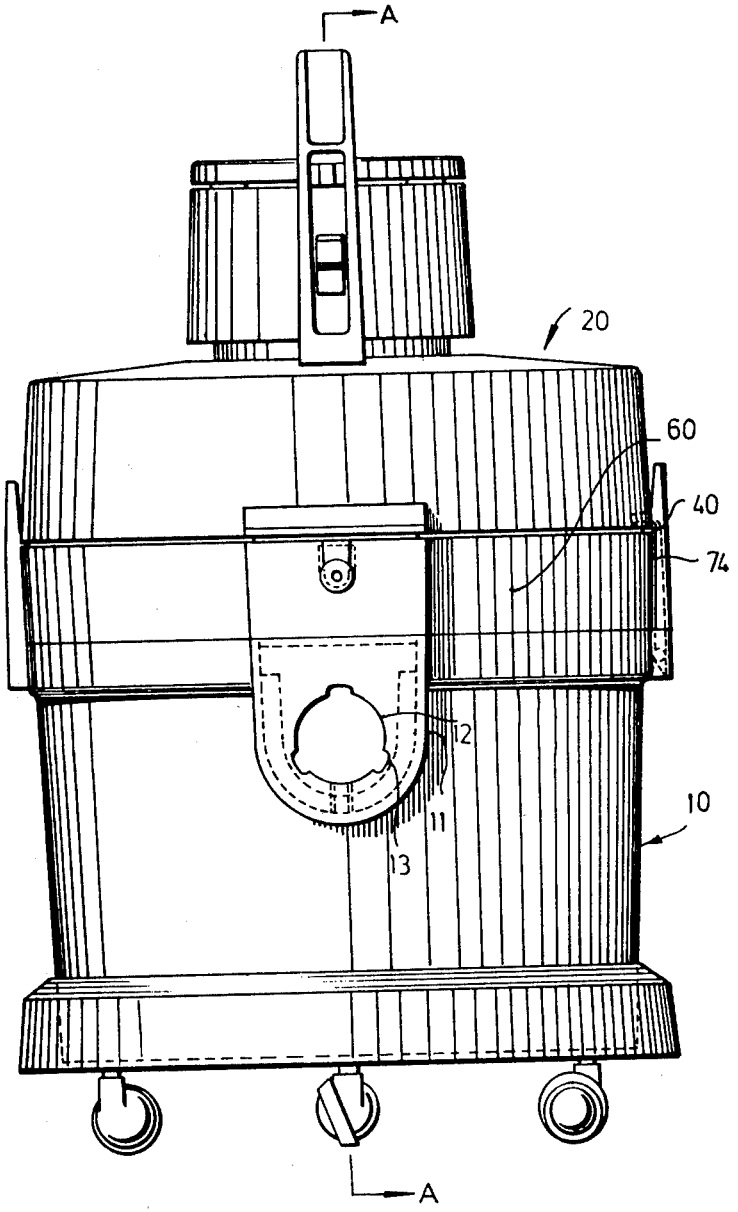
FIG. 1 shows a preferred embodiment of suction cleaning apparatus in front view and with a removable clean water reservoir in position.

The suction cleaner illustrated in the accompanying drawings includes a circular main container 10 having an open top closed by a top cover assembly 20 with the interposition of either a reservoir 60 if the cleaner is to be used for water extraction cleaning, or a dust filter assembly (not shown) if it is to be used for dry suction cleaning. An impeller 27 driven by an electric motor for creating the suction is housed in the top cover assembly 20, together with a valve assembly 40 whereby exhaust air from the impeller is directed to the interior of the reservoir when the latter is in place or alternatively allowed to escape to atmosphere when the reservoir is not in place.

The main container 10 is formed on its side wall 10*a* with a lateral protruberance 11 for the reception of an end fitting (not shown) of a suction hose. The protruberance 11 is formed, for this purpose, with a circular aperture 12 with recesses 13, and an opening 14 is formed opposite thereto in the upper portion of the side wall 10*a* of the container 10 so that air, together with any dust or water entrained therein, enters from the hose directly into the interior of the container in a generally radial direction.

The impeller 27 in the top cover assembly 20 has an intake at its underside arranged to draw air from beneath the top cover assembly and exhaust air from the impeller is directed by the valve assembly 40 either to the external atmosphere or through a central outlet aperture 34 concentric with a ring 35 which defines an air inlet duct for the impeller.

Figure 2:
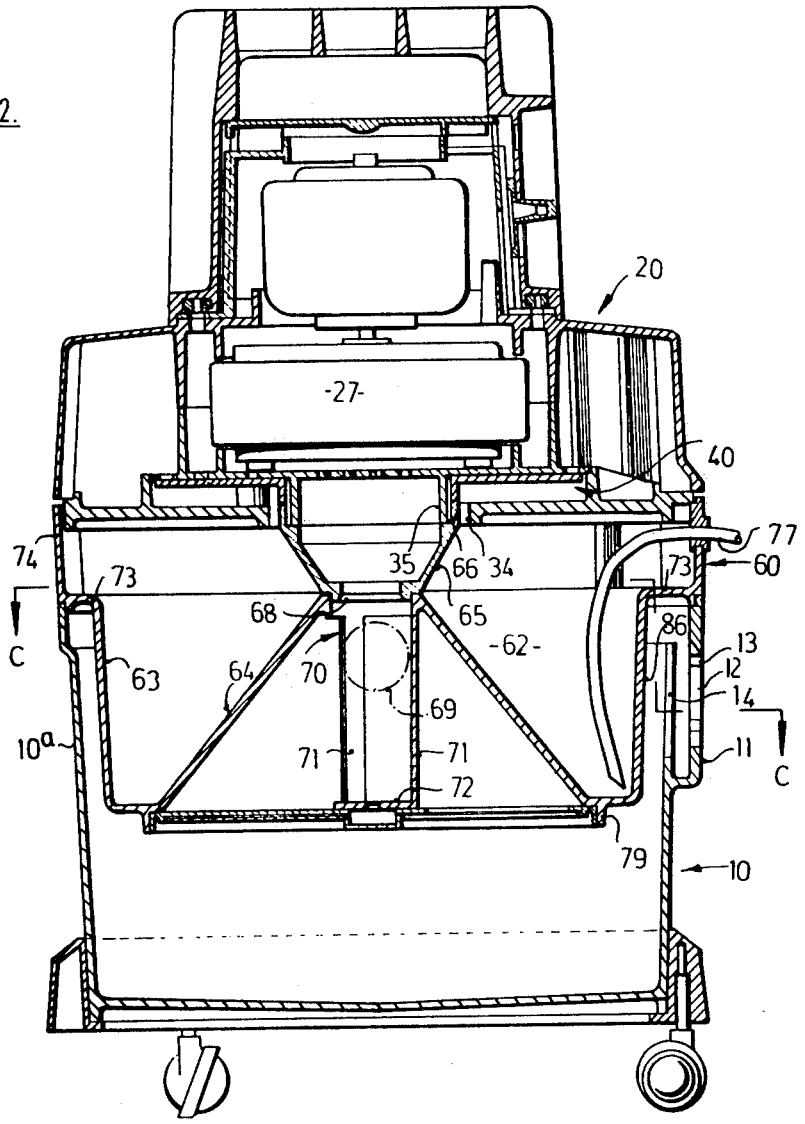
FIG. 2 shows a transverse section on the line A—A of FIG. 1.

The reservoir 60 includes an outer ring 74 which is interposed between the upper edge of the main container 10 and the lower edge of the top cover assembly 20, as shown in FIGS. 1 and 2. The outer ring 74 has an inwardly directed flange 73 which supports an integral annular trough 62 which is defined by an annular wall 63 and a downwardly inclining frusto-conical inner wall or cone 64. The cone 64 supports a boss 65 which coacts with the valve assembly 40 so as automatically to direct exhaust air from the impeller 27 into the interior of the reservoir through the aperture 34. In this way, sufficient pressure is generated within the trough 62 to displace cleaning liquid therefrom through a pipe 77 for delivery to a cleaning head (not shown) at which liquid is applied to a carpet or other like floor covering or other material which is to be cleaned.

The boss 65 serves to place the inlet of the impeller 27 in communication with the main container 10 beneath the reservoir 60 and this functions as a suction inlet for the container. In this way, suction is applied to the previously mentioned hose which is connected to the main container 10 by means of the aperture 12 and extends to the cleaning head so as to pick up used cleaning liquid.

Figure 3:
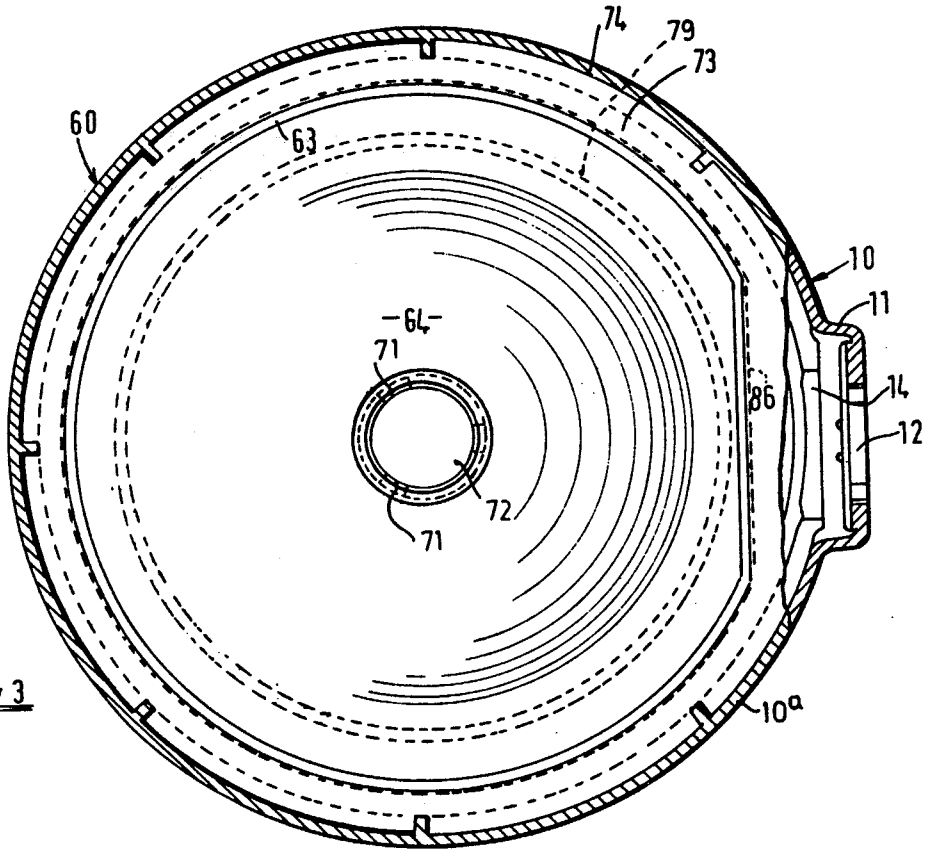
FIG. 3 shows a horizontal section on the line C—C of FIG. 2.

To facilitate separation of entrained liquid droplets from the incoming air, the air flow is arranged to impinge directly on a flat face 86 afforded by the annular wall 63 of the trough 62 which, as best seen in FIGS. 2 and 3 is spaced inwardly from the outer wall 10*a* of the container. In this way, the incoming air tends to spread out in all directions and the sudden change in direction of flow when the air impinges on the flat face 86 assists in separation of the liquid droplets which collect on the outer face of the annular wall 63 and drain down so as to collect on a flange 79 formed at the underside of the trough 62, which is spaced above the bottom of the container 10, so that the liquid then drips into the body of the main container 10.

The arrangement whereby the incoming air from the suction hose enters the main container 10 substantially radially and flows in opposite directions around the annular wall 63 of the trough 62 serves largely to prevent a swirling action and the establishment of a vortex in a manner which would tend to generate foam on the surface of liquid collected within the container 10.

In order to prevent liquid being sucked up into the impeller 27 is the capacity of the main container is exceeded, an overflow valve 70 is provided. This consists of a spherical float 69 confined between three guides 71 which extend downwardly from the centre of the cone 64 and carry at their lower ends a disc 72. The boss 65 carried by the cone 64 is formed with a seating 68 against which the float 69 will engage sealingly so as to prevent the passage of water upwardly into the intake chamber 43. In the illustrated embodiment, the float 69 is made of thin plastics material so as to be capable of being lifted solely by air flow. In practice, if the level of liquid in the container 10 rises to such a height that it enters the space beneath the cone 64, and thus lifts the float 69 towards the seating 68, the flow of air which continues to be drawn beneath the trough 62 through the liquid in the container will eventually lift the float up to seating 68 before the water level reaches the lower edge of the hose inlet aperture 12.

Although the invention has been described in relation to an appliance in which cleaning liquid is delivered to the cleaning head by pressurisation of the reservoir 60 by means of the exhaust air from the impeller 27, it wil be appreciated that the invention is applicable to other types of suction cleaning apparatus in which the cleaning liquid is delivered by other methods, for example by means of a suitable pump, and to suction cleaners which are not adapted themselves to deliver liquid to a cleaning head, but are only intended for picking up a cleaning liquid. In a case where there is no liquid reservoir, or where such reservoir is not disposed within the container, the latter, or the cover member 20, or some other part interposed between the container and the cover member, will then serve to support an annular wall corresponding to the wall 63 of the trough 62 of the illustrated embodiment.

I claim:

1. Apparatus for use in suction cleaning devices or the like comprising a container adapted for the collection of a liquid and including:

a closed bottom wall;

a lateral side wall which is circular in plan;

inlet means for connection with a suction head adapted for picking up liquid, said inlet means being disposed in the lateral side wall of the container for directing incoming air flow substantially radially inwardly;

suction inlet means for connection with a source of suction;

reservoir means for cleaning liquid in the form of an annular trough supported within the container;

means for delivering cleaning liquid from the reservoir means to suction head connected to said inlet means; and deflector means disposed between said inlet means and said suction inlet means and surrounding the latter, said deflector means comprising an outer part of said annular trough which defines an inner wall of circular form spaced inwardly from said side wall with a lower edge spaced above the bottom wall of the container.

2. Apparatus for use in suction cleaning apparatus or the like as recited in claim 1 wherein the trough is provided at its underside with a downwardly extending circular rib.

3. Apparatus for use in suction cleaning apparatus or the like as recited in claim 1 wherein said trough includes a generally conical inner part leading up to the suction inlet means.

4. Apparatus for use in suction cleaning apparatus or the like as recited in claim 3 wherein shut-off valve means is provided in register with said suction inlet means to close such suction inlet means in response to a predetermined level of the contents of the container.

* * * * *